US007874043B2

(12) United States Patent
Salice

(10) Patent No.: US 7,874,043 B2
(45) Date of Patent: Jan. 25, 2011

(54) FURNITURE HINGE WITH DAMPING DEVICE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 169 days.

(21) Appl. No.: 10/584,830

(22) PCT Filed: Nov. 8, 2005

(86) PCT No.: PCT/EP2005/055827

§ 371 (c)(1),
(2), (4) Date: Jun. 27, 2006

(87) PCT Pub. No.: WO2005/051074

PCT Pub. Date: May 18, 2005

(65) Prior Publication Data

US 2007/0136990 A1 Jun. 21, 2007

(30) Foreign Application Priority Data

Nov. 12, 2004 (IT) ..... RM200400179 U

(51) Int. Cl.
*E05F 1/08* (2006.01)

(52) U.S. Cl. ..... 16/286; 16/327; 16/337; 16/335

(58) Field of Classification Search ..... 16/286, 16/287, 288, 272, 271, 327, 337, 335; 312/319.1, 312/319.2, 326, 329
See application file for complete search history.

(56) References Cited

U.S. PATENT DOCUMENTS 3,102,311 A * 9/1963 Harold et al. ..... 24/16 PB
5,548,870 A * 8/1996 Grass, sen. ..... 16/254
6,715,183 B1 * 4/2004 Lautenschlager ..... 16/286
6,859,979 B2 * 3/2005 Egger et al. ..... 16/327
7,059,018 B2 * 6/2006 Koshikawa et al. ..... 16/302
7,065,833 B2 * 6/2006 Kropf ..... 16/286
7,096,535 B2 * 8/2006 Lin ..... 16/287
2003/0200625 A1 10/2003 Zimmer
2005/0015927 A1 * 1/2005 Kropf ..... 16/286

FOREIGN PATENT DOCUMENTS

DE 101 21977 11/2002
DE 102 11 294 A1 9/2003
WO WO 03/087512 A 10/2003
WO WO 03087512 A1 * 10/2003

OTHER PUBLICATIONS

International Search Report in English.

* cited by examiner

*Primary Examiner*—Victor Batson
*Assistant Examiner*—Emily M Morgan
(74) *Attorney, Agent, or Firm*—Collard & Roe, P.C.

(57) ABSTRACT

Furniture hinge with damping and/or braking device in alternative to those already existing and capable of guaranteeing an improved efficiency during the closing and/or opening operation of doors, or other furniture parts, without any variations to the overall dimensions of standard hinges. The improved efficiency of the hinge is obtained by increasing the friction surfaces with a viscous medium present in suitable areas of the hinge and/or by allowing regulation of the trend of the angular velocities of one or more circular shaped elements, for example a disc, which act as braking elements in contact with the viscous medium.

19 Claims, 11 Drawing Sheets

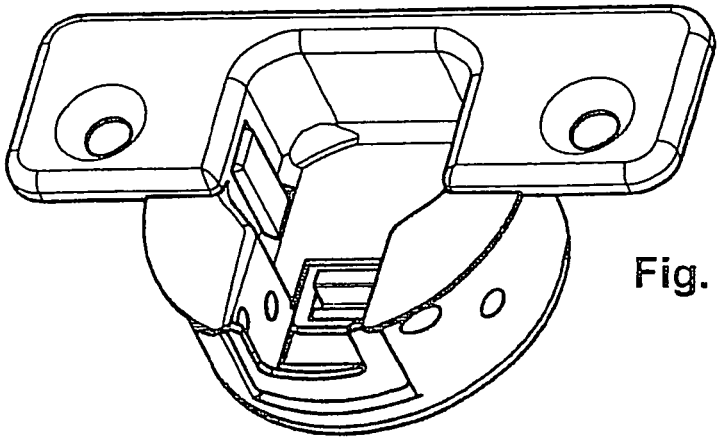
Fig. 6
Fig. 7a
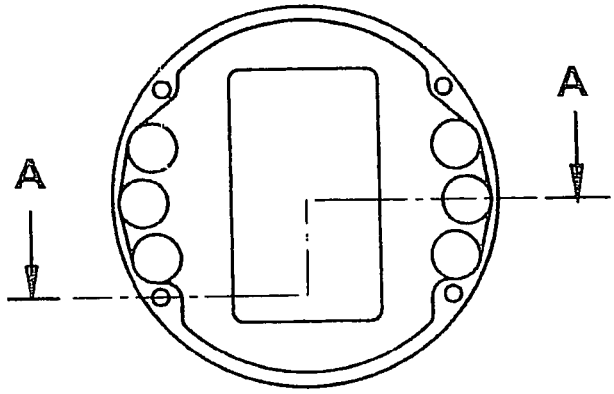
Fig. 7b
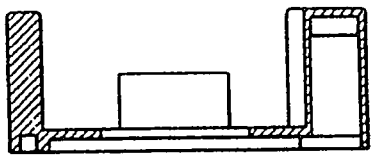
Fig. 8a
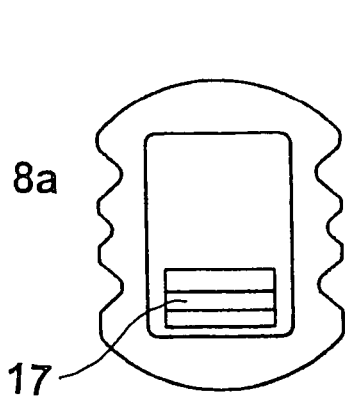
Fig. 8b
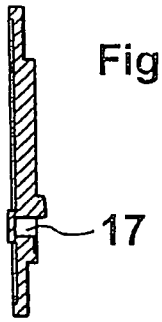

100
18''
23'
30
28

18''
23'
32

28
29
27
100
31
16'
8
26'
3
B

18''
29
23'
27
32

FURNITURE HINGE WITH DAMPING DEVICE

CROSS REFERENCE TO RELATED APPLICATIONS

Applicant claims priority under 35 U.S.C. §119 of Italian Application No. RM2004U00179 filed Nov. 12, 2004. Applicant also claims priority under 35 U.S.C. §365 of PCT/EP2005/055827 filed Nov. 8, 2005. The international application under PCT article 21(2) was published in English.

FIELD OF THE INVENTION

The present invention relates to a furniture hinge, in particular a hinge with spring for doors, or in general for parts of furniture suitable to be brought into motion, provided with a damping device which acts during opening and/or closing of the doors.

STATE OF THE ART

Furniture, provided with doors or wings to close compartments and which open by pivoting about a horizontal or vertical axis, use various types of hinge. A type which is very widely used today is one in which the hinges to support the doors in the closed position are not visible from the outside of the piece of furniture when the door is closed.

Hinges of this type are today commonly used in the furniture industry as they have a series of advantages, which have determined their extensive use on the market.

Some embodiments of known hinges are provided with springs of various types to produce a return force during closing or a pushing force during opening of the doors to which they are fitted. This allows very precise closing or opening of the doors.

Nonetheless, damping and/or braking devices-of the door movement, caused by the elastic reaction of the spring, are desirable, in these hinges. The object of these devices is above all to prevent noise caused during closing operations by doors banging shut against the body of the piece of furniture.

There are currently various known damping and braking devices integrated in furniture hinges. One of these devices is described in the patent DE10121977. This comprises a slider, brought into motion directly or indirectly by one of the hinge rockers, which has at least one sliding surface along a fixed surface of the hinge. A highly viscous liquid is inserted between the surfaces. In the preferred embodiment the movable slider is disposed on the cup or box element of the hinge and the fixed surface is that of the outer base of said cup.

SUMMARY OF THE INVENTION

The object of the present invention is to produce a furniture hinge which has an alternative damping and braking device with respect to those already existing, guaranteeing improved efficiency during the closing and/or opening operation of the doors, or other parts of the piece of furniture, without variations to the overall dimensions of standard hinges.

A further important object of the hinge of the invention is to provide a modular structure which considerably facilitates the construction and final assembly, also allowing optimisation of the use of production lines.

Therefore, the present invention proposes a solution to the problems discussed above by producing a furniture hinge with a damping device having the characteristics of the claim 1.

The improved efficiency of the hinge, forming the object of the present invention, is obtained by increasing the friction surface with a viscous medium present in suitable areas of the hinge and/or allowing regulation of the trend of the angular velocities of one or more circular shaped elements, for example a disc, which act as braking elements in contact with the viscous medium.

Advantageously, it is possible to perform the damping and/or braking action in both the phases of opening and closing of the door or other part of the piece of furniture, or exclusively during one of these phases.

Another advantage is represented by the fact that the damping device of the hinge of the invention forms a separate element which can be mounted, already assembled, with extreme ease in different embodiments of the hinge, even differing greatly from one another, on the base of a box element, or simply box, of standard type. In fact, as in the hinge of the invention the box element is separated from the damping device, it does not contribute towards the damping actions and can be produced with standard materials, for example simply by stamping, and does not require the use of more costly materials particularly suitable for damping.

From a production viewpoint all this implies that on a first production line it is possible to continue producing standard type hinges, while assembly of the damping device on said hinges, when required, is performed separately on a second independent line. Consequently, it is unnecessary to provide lines entirely dedicated to the production of hinges with integrated damping device.

Moreover, while assembly of state of the art hinges provides for subsequent mounting on the box element of the elements forming the damping device one at a time, in the hinge of the invention said device, already assembled separately, is mounted on the base of the box of the hinge with a single, simple and quick operation. The box element therefore does not act as supporting element during mounting of the elements of the damping device.

In an advantageous embodiment fixing of said device to the box is performed by the same two pins forming the-articulation of the hinge rockers.

The standard box element is advantageously provided with an opening on the base thereof and has a shape suitable for quick assembly with different embodiments of the damping device. Moreover, in order to produce hinges provided with damping device it is sufficient for one of the two rockers to be provided on the first production line with a connection element capable of interacting, through the opening on the base of the box element, with a slider of the damping device. This connection element can, for example, be formed by one end of said rocker or by tabs produced thereon or by a separate element connected to the rocker or inserted thereon and pivoting about the respective pin.

Finally, a further advantage is that said damping device, thanks to its compactness and being mounted on the base of the box element, is incorporated inside the thickness of the furniture door and is therefore invisible when the door is opened, also improving the aesthetic appearance.

The dependent claims describe preferred embodiments of the invention.

BRIEF DESCRIPTION OF THE FIGURES

Further characteristics and advantages of the invention shall be more apparent in the light of the detailed description of preferred, although non-exclusive, embodiments of a furniture hinge with damping device illustrated, by way of a non-limiting example, with the aid of the accompanying drawings wherein:

FIG. 6 shows a perspective view of the assembled detail in FIG. 5;

FIGS. 7*a* and 7*b* respectively show a plan view of part of the detail in FIG. 5 and the section of this view along the line A-A;

FIGS. 8*a* and 8*b* respectively show a plan view of a detail of the hinge and a vertical section of this view;

DETAILED DESCRIPTION OF PREFERRED EMBODIMENTS OF THE INVENTION

Figure 3:
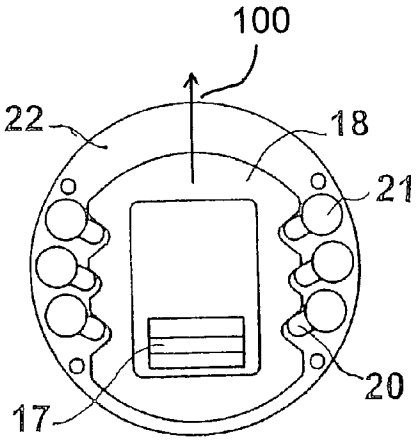
FIGS. 3 and 4 show plan views of the inside of a detail of the hinge corresponding to the two positions of the hinge in FIGS. 1 and 2 respectively.
Figure 4:
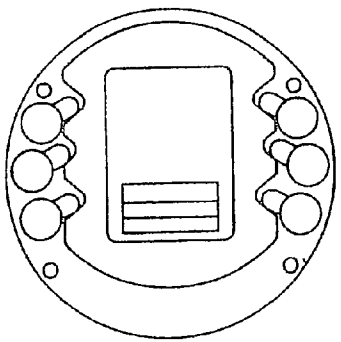
Figure 1:
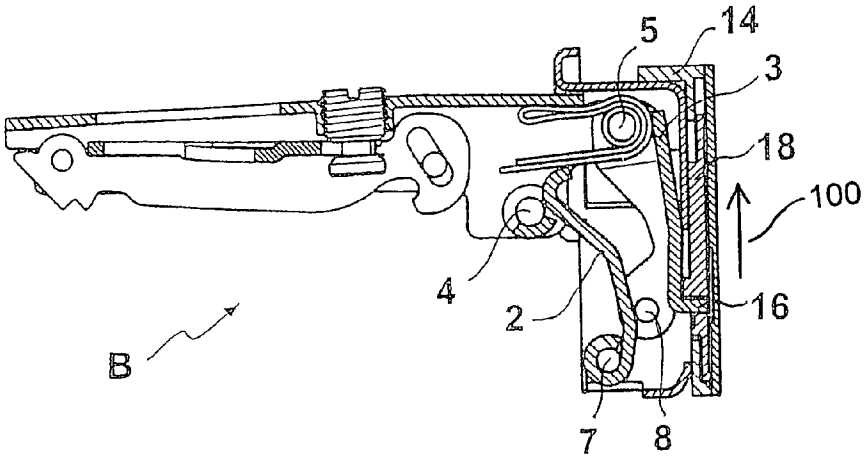
FIGS. 1 and 2 show sectional views of a hinge in two different positions.

With reference to FIG. 1, a hinge is represented, indicated as a whole with the reference B, comprising a fixed element, or hinge arm 1, which is fixable on a base, or plate, in turn fixed integrally to a bearing wall of a side panel or any suitable element of a piece of furniture. The hinge is provided with two rockers 2 and 3, with a respective first end thereof pivoting about two respective pins 4, 5 housed in holes in the side walls of the arm 1. The arm 1 is connected to a box element 6, fixed in a cavity produced in the inside wall of the door or wing of the piece of furniture, or of any other appropriate pivoting element of the piece of furniture. The two respective second ends of the rockers 2 and 3 are housed in rotation on other two respective pins 7, 8 with axes parallel to the first two pins 4, 5. The four pins 4, 5, 7, 8 form a articulated quadrilateral.

Around the hinge pin 5, connecting the rocker 3 to the arm 1, there is provided an elastic element or spring 9. One of the arms 10 of said elastic element is resting on the hinge arm 1, while the other arm 11 reacts on the rocker 2.

Figure 2:
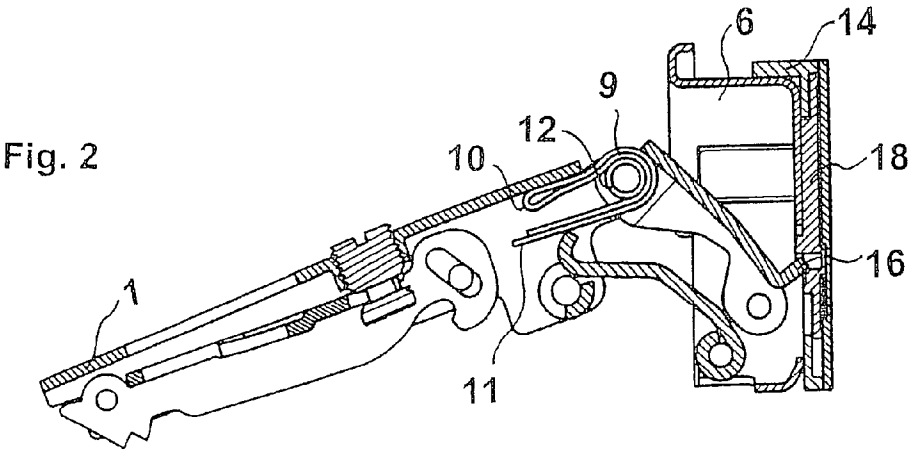

Closing of the arms 10, 11 of the elastic element 9 is established so that this element 9 exerts a pushing force on the rocker 2 until the position shown in FIG. 2. Beyond this opening angle of the door, approximately from 15 to 20°, the elastic element 9 has a compression with a negligible application arm, so that the remaining part of the pivoting movement of the door takes place freely without being influenced by the presence of elastic forces.

On the other hand, in the closing phase of the door, the elastic element produces a return force in the closing direction which allows a precise and spontaneous closing of the door in the final angular space, with an amplitude of approximately 15 to 20°.

A bushing 12 can be appropriately interposed between the elastic element 9 and the pin 5. Alternatively, the element 9 can be detached from the pin 5 and be anchored in a known way to the hinge arm 1.

Figure 5:
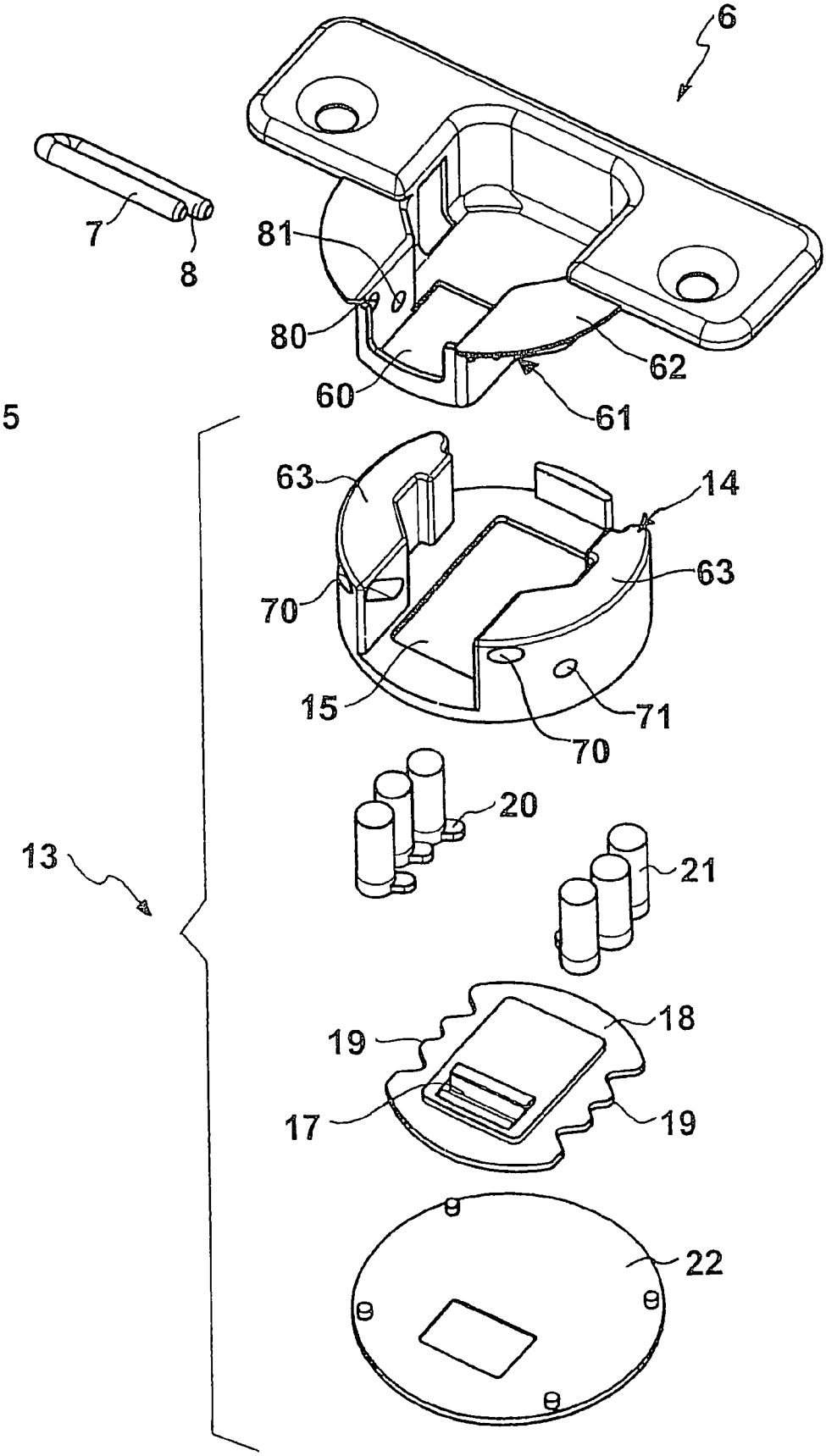
FIG. 5 shows an exploded view of the detail in FIGS. 3 and 4.

On the base of the box element 6 there is mounted advantageously a damping and/or braking device 13 suitable to reduce releases which take place during the opening and/or closing phases of the doors, reducing noise and allowing these phases to take place comfortably and smoothly. This device 13 comprises, as illustrated in FIG. 5, a housing formed of an appropriately shaped casing 14 to allow fixing thereof to the box element 6, and of a base disc 22. Advantageously assembly of damping device 13 and box element 6 can also take place by means of the same pins 7, 8, about which the second ends of the rockers 2 and 3 respectively pivot, said pins passing through the corresponding holes 70, 71 of the casing 14 and the holes 80, 81 of the box element 6. The base of the casing 14 has is provided with a hole or opening 15, substantially rectangular, to allow a connection element 16, fixed to the lower end of the rocker 3 or integral therewith, to engage in a corresponding seat 17 provided on a slider 18, thereby controlling translation of said slider in a first or second direction 100 corresponding to the pivoting direction of the hinge. The slider 18 has a series of peripheral teeth 19 which are suitable to engage arms 20 projecting from the perimeter of cylinders 21, to produce a pivoting of said cylinders about the axis thereof. The cylinders 21 are housed inside the casing 14, closed underside by a base disc 22, and are immersed in a viscous medium. Thanks to the pivoting motion of the cylinders and to the friction of the surfaces thereof with the viscous medium the efficienacy of damping is improved. In this way, in fact, the total friction surface with the viscous medium is considerably increased without any variations to the overall dimensions of standard hinges.

A first advantageous embodiment of the hinge, shown in FIGS. from 9 to 16, comprises a damping device 13' provided with a slider 18', substantially rectangular in shape, on the upper surface of which there is provided an appropriate seat 17' in which the connection element 16 engages, and on the lower surface of which there is provided a tappet element 25, for example a pin, housed inside a cam groove 24 produced on an underlying substantially flat shaped braking disc 23. A ring 26 allows a lock joint closure of the damping device 13' by means of appropriate bosses suitable to engage in seats of a complementary shape provided on the base of the casing 14'. Ring 26 and casing 14' therefore form the housing of the damping device 13'. Also in this case the device 13' can be fixed to the box element 6 by means of the articulation pins 7, 8 of the rockers 2 and 3, said pins passing through the corresponding holes 70', 71' of the casing 14' and the holes 80', 81' of the box element 6.

Thanks to this arrangement of the various elements of the hinge of the invention, during the opening or closing movement of the hinge, the connection element 16 of the rocker 3, engaging in the seat 17', transmits a translational motion to the slider 18'. The slider 18' is provided on the edges 58' with ribs which, once the damping device has been assembled, are engaged in corresponding grooves 54' provided along the edges of the opening 15' of the casing 14'. In this way the slider can translate without becoming detached from said device.

Figure 9:
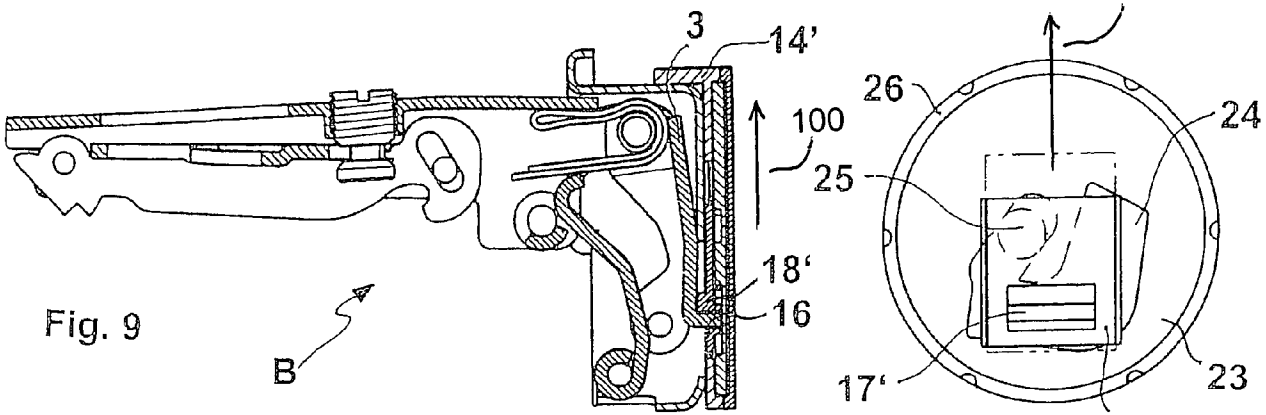
FIGS. 9 and 10 show sectional views in two different positions of a first embodiment of the hinge of the invention.
Figure 11:
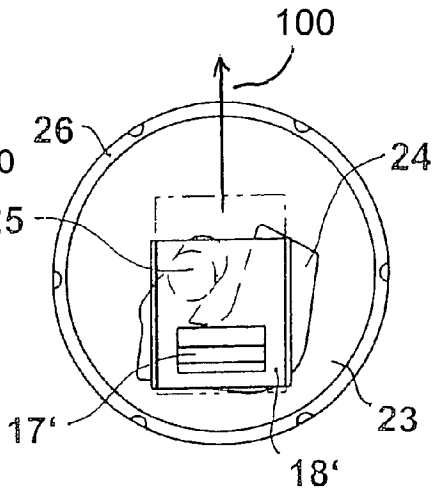
FIGS. 11 and 12 show plan views of the inside of a detail corresponding Respectively to the two positions of the hinge in FIGS. 9 and 10.
Figure 10:
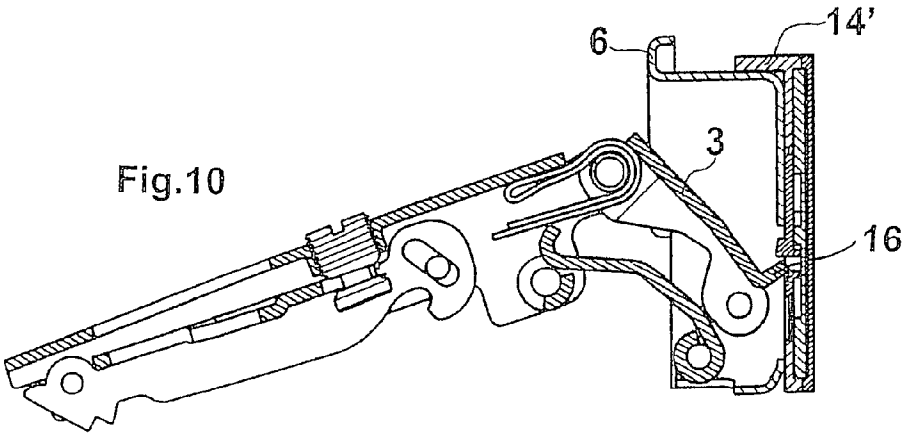
Figure 12:
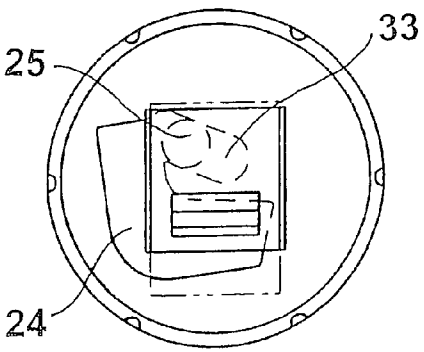
Figure 13:
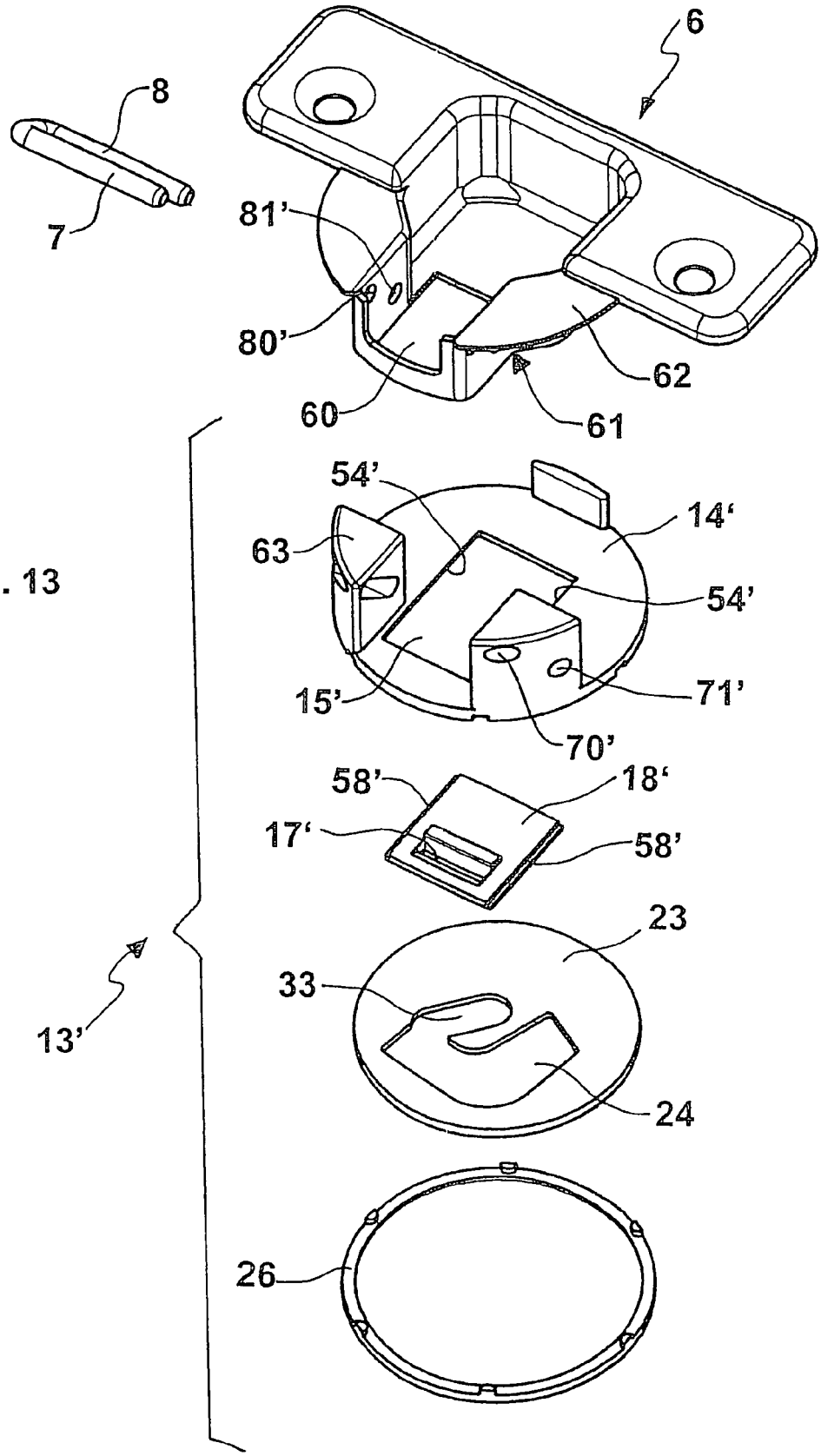
FIG. 13 shows an exploded view of the detail in FIGS. 11 and 12.
Figure 14:
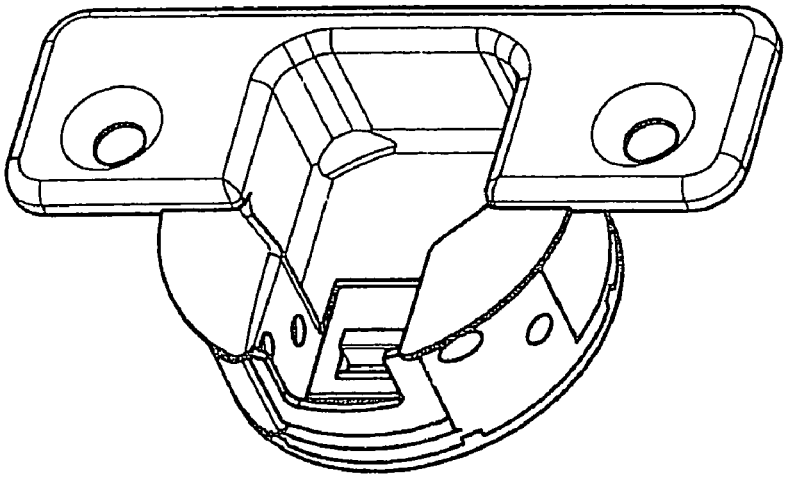
FIG. 14 shows a perspective view of the assembled detail in FIG. 13.
Figure 15A:
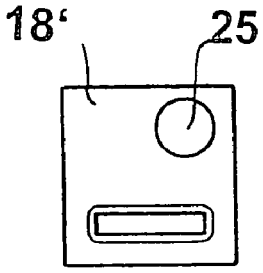
FIGS. 15*a*, 15*b* and 15*c* respectively show a bottom view, a side view and a top view of a detail of the hinge in FIG. 9.
Figure 15B:
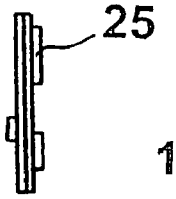
Figure 15C:
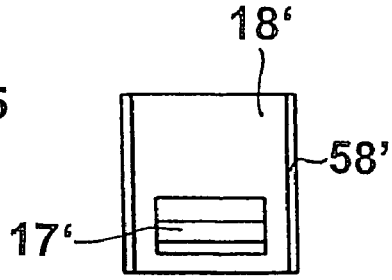
Figure 16:
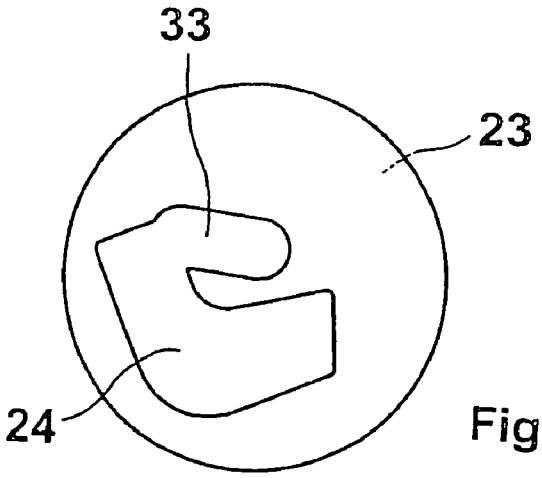
FIG. 16 shows a plan view of a further detail of the hinge in FIG. 9.

During this translation, for example due to movement from the partly open position in FIG. 10 to the closed position of the hinge in FIG. 9, the tappet element 25, housed in the appropriately shaped area 33 of the cam groove 24, moves along this area causing a pivoting of the braking disc 23. All the elements of the damping device are immersed in a suitable viscous medium. This embodiment has the advantage of allowing, by means of the transmission of motion by the tappet element, a different trend of the angular velocities of the disc 23 to be obtained according to the angular position of the door, by appropriately defining the shape of the groove. Advantageously, by means of the hinge of the invention, it is possible to perform the damping and/or braking action exclusively, according to choice, in only one of the two phases of opening and closing of the door.

With reference to FIGS. 17 to 24,a second embodiment of the hinge has a damping device 13" provided with a slider 18", suitable to be brought into motion by a connection element 16' of the hinge which, in this example, does not form the end of the rocker 3 but a separate element, in any case connected to the rocker 3, pivoting about the pin 8. Also in this embodiment the slider 18" is provided on the edges 58" with ribs which, once the damping device 13" has been assembled, are engaged in corresponding grooves 54" provided along the edges of the opening 15" of the casing 14". In this way the slider 18" can translate without becoming detached from said device.

Figures 17, 18, 19, 20:
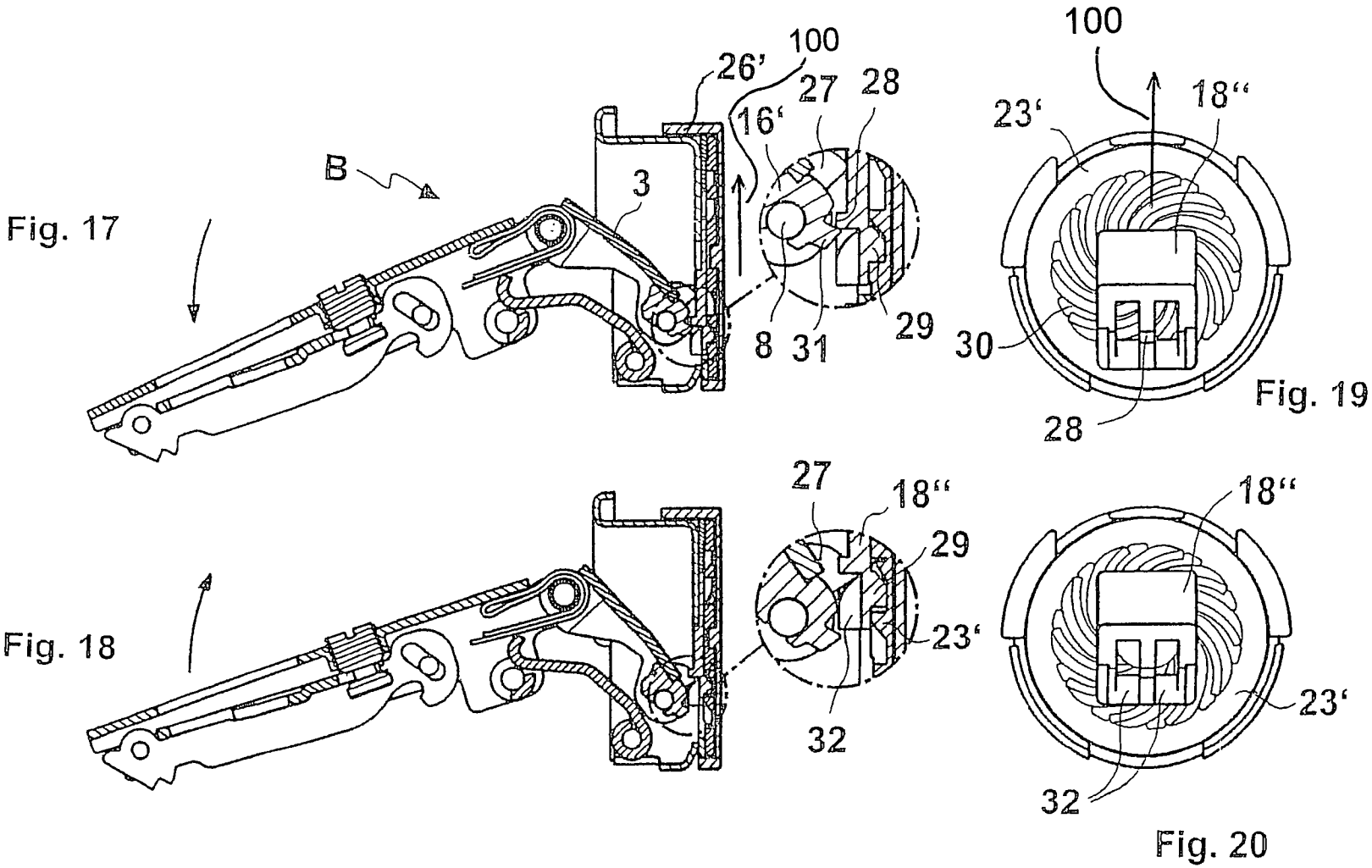
FIGS. 17 and 18 show sectional views in two different positions of a second embodiment of the hinge of the invention.
FIGS. 19 and 20 show plan views of the inside of a detail of the hinge corresponding respectively to the two positions of the hinge in FIGS. 17 and 18.
Figure 21:
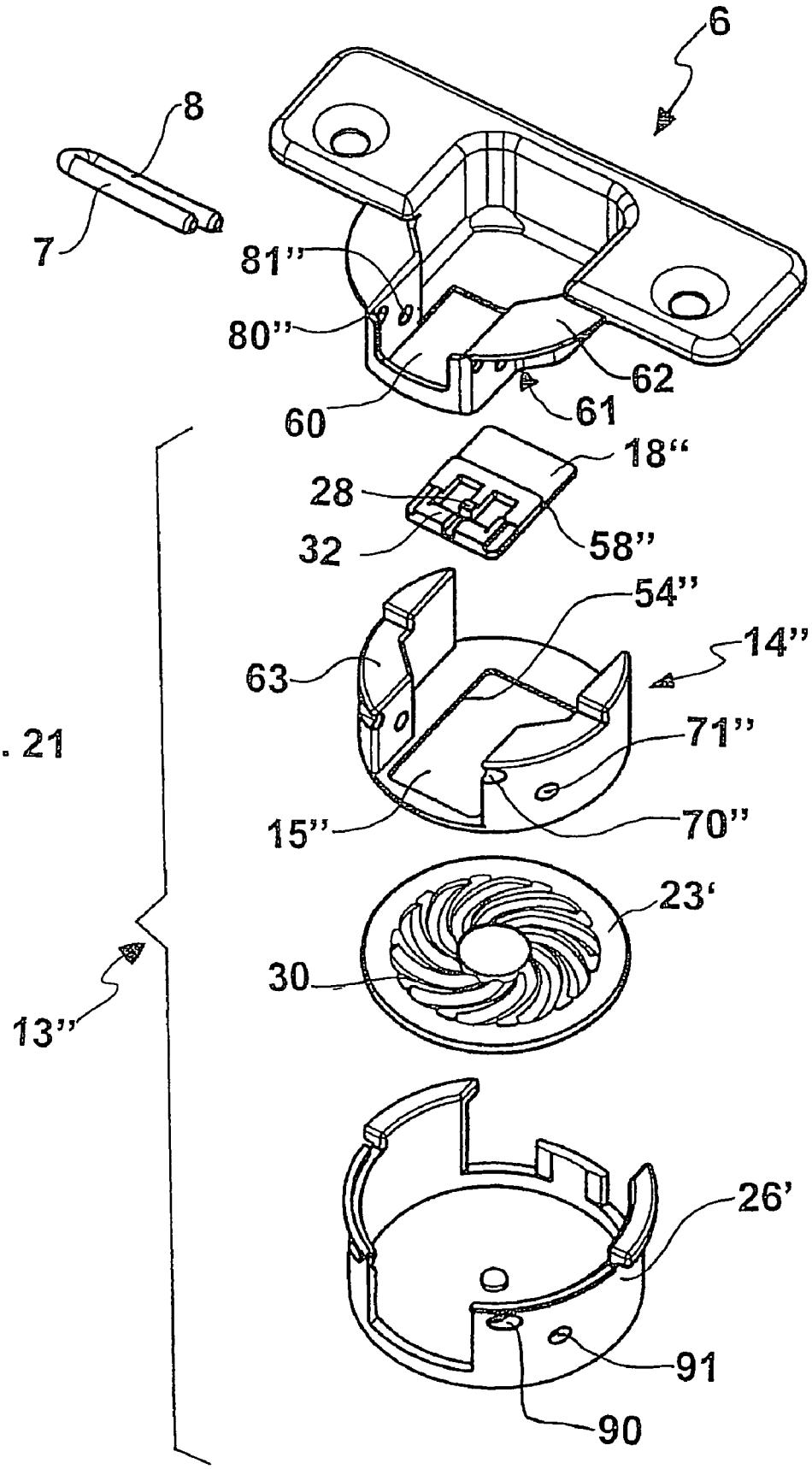
FIG. 21 shows an exploded view of the detail in FIGS. 19 and 20.
Figure 22A:
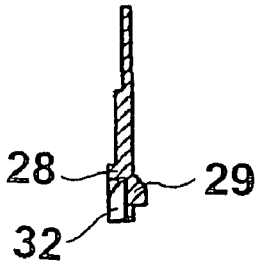
FIGS. 22*a*, 22*b* and 22*c* respectively show a vertical section, a top view and a bottom view of a detail of the hinge in FIG. 17.
Figure 22B:
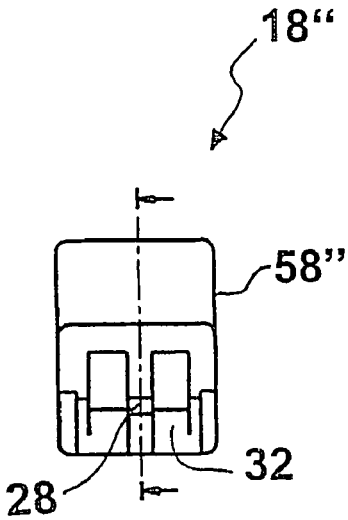
Figure 22C:
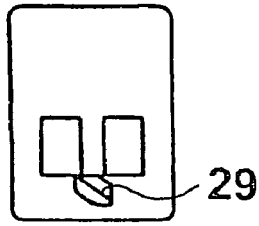
Figure 23:
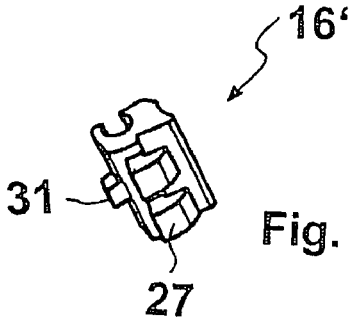
FIG. 23 shows a perspective view of a further detail of the hinge in FIG. 17.
Figure 24A:
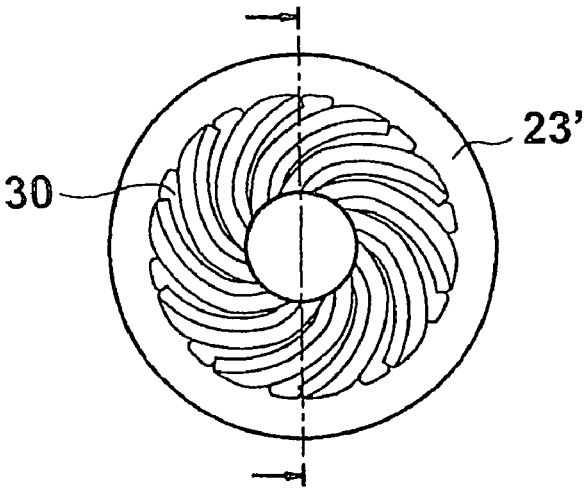
FIGS. 24*a* and 24*b* respectively show a plan view of an element of the hinge in FIG. 17 and a vertical section thereof.
Figure 24B:
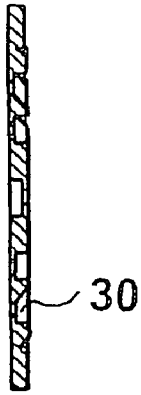
Figure 25:
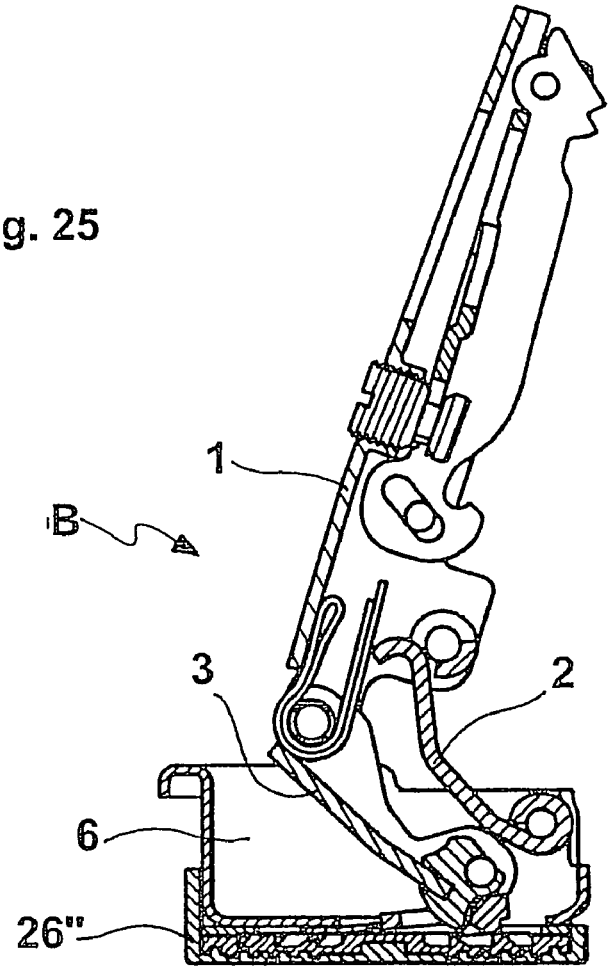
FIG. 25 shows a sectional view in a semi-open position of a third embodiment of the hinge of the invention.
Figure 26:
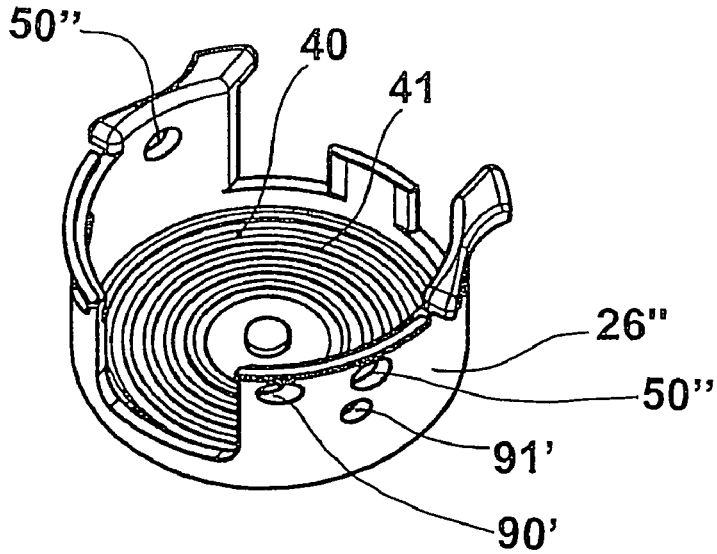
FIG. 26 shows a perspective view of a detail of the hinge in FIG. 25.

This connection element or cam 16', in the example in FIG. 23, has a tooth 31 which during the door opening phase in FIG. 17 brings the slider 18" into translation by pressing on the projection 28 of the same slider. The lower surface of the slider 18" is provided with at least one protuberance 29 coupled with at least one of the spiral grooves 30, provided on the underlying braking disc 23', by means of a profile complementary to the profile with saw tooth section of said grooves. In the opening phase, translation of the slider takes place by a lifting of the protuberance 29 which engages in a groove adjacent to the initial one, while the disc 23' does not move. On the other hand, in the door closing phase the projections 27 of the element 16' act on the projections 32 of the slider 18" causing pivoting of the braking disc 23' and consequently the damping action. Also in this example all the elements of the damping device are immersed in a viscous medium. Casing 14" and base 26' form the housing of the slider 18" and of the braking disc 23. In this embodiment the articulation pins 7, 8 of the rockers 2 and 3 advantageously fix the device 13" to the hinge passing through the corresponding holes 90, 91 of the base 26', the holes 70", 71" of the casing 14" and the holes 80", 81" of the box element 6.

Figure 27:
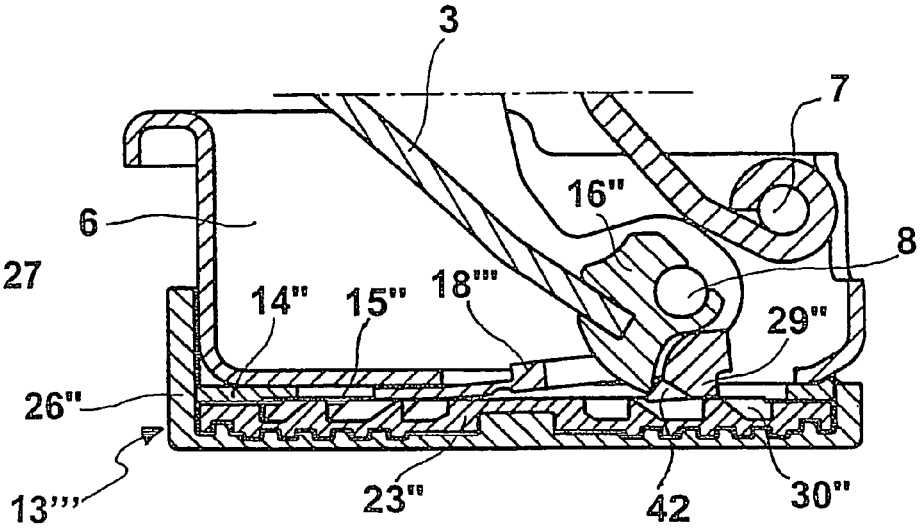
FIG. 27 shows the enlargement of part of the sectional view in FIG. 25.
Figure 28:
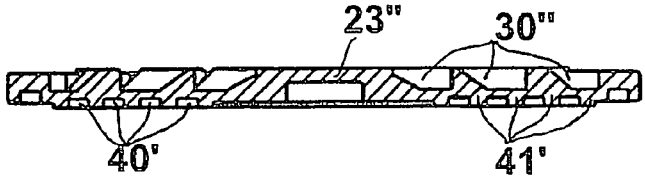
FIG. 28 shows a sectional view of another detail of the hinge in FIG. 25.
Figure 29:
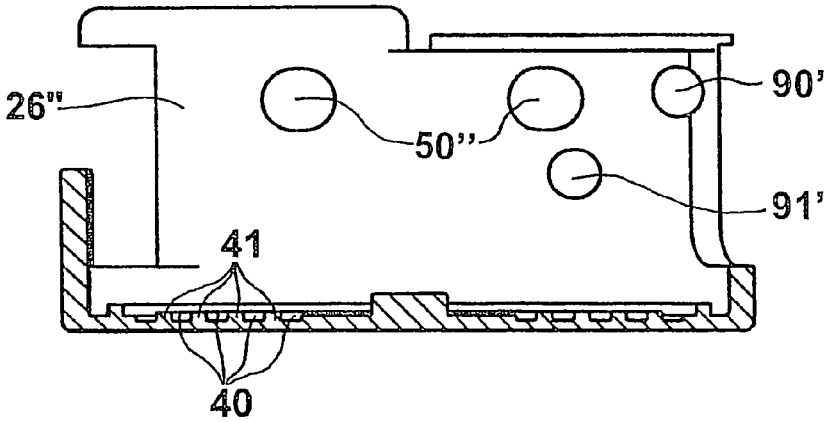
FIG. 29 shows a sectional view of the detail in FIG. 26.
Figure 30:
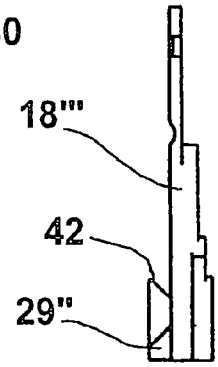
FIG. 30 shows a side view of a further detail of the hinge in FIG. 25.
Figure 31:
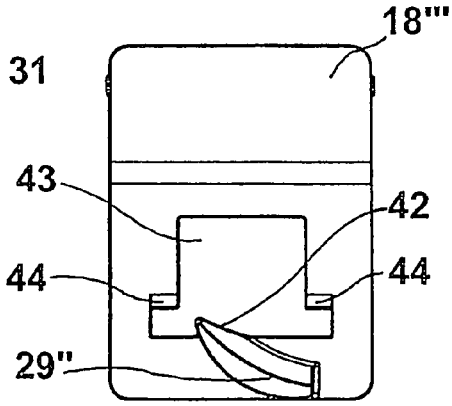
FIG. 31 shows a bottom view of the detail in FIG. 30.

Finally, with reference to FIGS. 25 to 31, in a third embodiment of the hinge, comprising a damping device 13''', a series of complementary concentric annular grooves 40', 40 and ribs 41', 41, which can be coupled as shown in FIG. 27, are provided on the facing surfaces of a braking disk 23" and of a base or bottom 26", between which a viscous medium is disposed. The flat part of the crests of the ribs and the base of the grooves can, moreover, be produced with a rough finishing to promote adhesion of the viscous medium, for example high viscosity grease, in contact with them.

Advantageously, this expedient makes it more difficult for the grease to move in a radial direction, so that the use of gaskets between the base 26" and the box element 6 of the hinge is unnecessary.

Between the braking disc 23" and the box element 6 there is provided a plate 14''', preferably circular, provided with an opening 15''' for the slider 18'''. A viscous medium is also disposed between the slider 18''' and the braking disc 23" with the dual purpose of contributing to the damping effect and above all of eliminating any noise caused by jumping over/snap engagement of a protuberance 29", provided on the lower surface of the slider, with the spiral grooves 30" provided on the upper surface of the braking disc 23" and having a profile complementary to the profile with a saw tooth section of the same protuberance 29". This viscous medium is advantageously the same as the one present between the disc 23" and the base 26".

Also in this embodiment the slider 18''' is suitable to be brought into translation by a connection element or cam 16" of the hinge, which does not form the end of the rocker 3 but is a separate element, although connected to the rocker 3, pivoting about the pin 8. This cam 16" is provided with side teeth, not shown in the figures but performing the same functions as the tooth 31 in FIG. 17, which during the door opening phase bring the slider 18''' into translation by pushing on the edges 44 of the slider.

In the door opening phase, translation of the slider 18''' takes place by a lifting of the protuberance 29" which engages in a groove adjacent to the initial one, while the braking disc 23" does not move. On the other hand, in the door closing phase, the connection element 16" acts on the protuberance 29". As this time the protuberance remains engaged in a groove of the braking disc 23", it exerts a thrust on the side wall of said groove causing rotation of the braking disc 23" and consequently the damping action.

Advantageously the protuberance 29" is provided with one substantially pointed end 42, projecting in a central opening 43 of the slider 18''', crossed by the cam 16". This end 42 allows correct operation of the damping device of the hinge even in abnormal conditions, for example, when the door is not completely opened, but is immediately closed again after being moved only by a small angle from its rabbet position against the piece of furniture. In this situation the slider 18''' can be in the position shown in FIGS. 25 and 27, with the protuberance 29" resting on a crest formed by the spiral grooves 30", pushed by the side teeth of the cam 16". If the door is closed again, the tip of the cam 16" rests on the inclined surface of the pointed end 42 pushing it downwards so that it presses against the crests of the teeth formed by the grooves 30", causing decelerated rotation of the braking disc 23" until reaching a new position of normal operation, obtaining the global braking effect for the hinge. Without this pointed end 42, if the door were closed again from the position in FIG. 25, the cam 16" connected to the rocker 3, by passing from a clockwise to a counter-clockwise movement, would move the protuberance 29" of the slider 18''' towards right, without this protuberance engaging with the profiles with saw tooth, sections formed by the grooves 30", and therefore without obtaining the braking effect. This expedient can also be used in other embodiments of the hinge described above.

In this third embodiment of the hinge the base 26" forms, together with the plate 14''', the housing for the slider 18''' and the braking disc 23"; while the pins 7, 8 allow the device 13''' to be fixed to the hinge by passing through the holes 90', 91' of the base 26" and the corresponding holes of the box element, not shown in the figures relative to this last embodiment.

Another advantageous expedient, which can also be employed in the other embodiments of the hinge, is to provide slots or holes 50" in the side walls of the base 26", in addition to the holes 90', 91' already provided for the pins 7 and 8 to pass through. Said holes 50" are suitable to couple corresponding projections, not shown in the figures, provided on the box element 6 in order to allow the damping device, already assembled, to be easily mounted on the hinge. Said slots or holes can also be provided on the base 26" of the damping device 13" of said second embodiment and on the casings 14, 14' of the relative devices 13, 13' of the other two embodiments of the hinge B.

Besides eliminating possible shortcomings in the operation of the damping device in abnormal situations, a further advantage of this third embodiment is that it makes the device unquestionably silent and the braking force more incisive, thanks to the increased extension of the coupled and friction surfaces with the viscous medium. This third embodiment makes it possible to obtain the same braking effect obtained with the previous embodiments using a smaller quantity of grease, or alternatively to obtain with the same quantity of grease a greater braking effect.

Optionally, the functions of the connections element 16', 16" can be obtained by means of an appropriate shape of tabs produced on the same plate forming the rocker 3.

The hinge of the invention consequently allows, in all the embodiments thereof, an efficient functioning without any variations to the overall dimensions of standard hinges, in view of the considerable compactness of the damping device 13, 13', 13", 13'''.

Advantageously, the production costs of the hinge of the invention are considerably low. In fact, all four embodiments of hinge described, according to the invention, have a great advantage from the structural viewpoint, namely that they comprise a damping device which, in the various embodiments thereof, forms a separate body and can therefore be mounted, already assembled separately, on the box element 6.

The box element can be of the type normally used to produce standard hinges, for example produced simply by stamping and provided in some cases with projections of reference which do not prevent conventional use of the hinge without any damping and/or braking device. This device, already assembled, can be combined with the box element chosen in the final assembly phase of the hinge, said pins 7, 8 being advantageously the essential elements used for fixing thereof. Therefore, it is possible to produce the various embodiments of the hinge of the invention provided with damping device without having to provide for particular operations with respect to assembly of standard hinges. In fact, only a single fixing operation is required to hold together the box element of the hinge and the damping device. Moreover, the latter has the advantage of disappearing entirely inside the thickness of the door and of being invisible from the outside.

Advantageously, the box element 6 is provided with:

an opening 60 on the base or lower surface thereof, to allow interaction of the connection element 16, 16', 16" of the rocker 3 with the slider 18, 18', 18", 18''';

and notches or indentations 61 on the side surface thereof which together with shelves 62, provided on the upper surface thereof and substantially having a shape of circular crown portion, define a space suitable to house corresponding projections 63 of the casings 14, 14', 14" or of the base 26", said casings and said base containing the elements forming the damping device.

The specific embodiments described herein do not limit the content of this application, which covers all the embodiments of the invention defined by the claims.

The invention claimed is:

1. Furniture hinge comprising:

a fixing arm for fixing to a piece of furniture, means for fixing to a door of said piece of furniture, incorporating a cup, first and second rockers, forming an articulated quadrilateral and joining said fixing arm to said cup so as to allow reciprocal pivoting thereof, a connection element fixed to the first rocker, damping means of said reciprocal pivoting comprising a slider, and damping moving elements, said slider being controlled in translation by the connection element and suitable to translate according to a first direction corresponding to a pivoting of the hinge, said slider cooperating with kinematic means for motion conversion suitable to convert a translational motion of the slider into a damping pivoting motion a housing wherein the damping means is disposed in said housing, with said housing being separate from said cup, enclosing said slider, said housing comprising a casing element separate from said cup and serving to guide the movement of said slider, said damping moving elements, and said kinematic means for motion conversion, and are provided with fast connection means to said cup so that said slider and said damping moving elements are suitable to be assembled with one another with the housing so that said damping means and said housing form a single element suitable to be fixed to one end of said cup in a single operation.

2. Hinge according to claim 1, wherein said fast connection means are pins suitable to engage first holes of the housing and second holes of the cup.

3. Hinge according to claim 1, wherein said damping moving elements are circular in shape, immersed in a viscous means which wets the outer surfaces thereof, and suitable to pivot about an axis perpendicular to the first direction so as to cause a braking force corresponding to movements of the hinge.

4. Furniture hinge according to claim 3, wherein said damping moving elements comprise a flat shaped disc.

5. Furniture hinge according to claim 3, wherein said damping moving elements comprise cylinders.

6. Furniture hinge according to claim 4, wherein the kinematic means for motion conversion comprise a groove in the form of a cam produced on the disc and a tappet element fixed to the slider.

7. Furniture hinge according to claim 4, wherein the kinematic means for motion conversion comprise a series of spiral grooves on the disc and a protuberance fixed on the slider which engages with at least one groove shaped to cause pivoting of the disc.

8. Furniture hinge according to claim 7, wherein the spiral grooves have profiles with saw tooth sections and the protuberance on the slider has a profile with a section having a complementary shape to the profiles of the grooves.

9. Furniture hinge according to claim 8, wherein the protuberance and the profile of the grooves are shaped to interact only in one direction of translation of the slider.

10. Furniture hinge according to claim 5, wherein the slider is provided with a series of peripheral teeth which are suitable to engage arms projecting from the perimeter of the cylinders so as to produce a rotation of the cylinders about an axis thereof.

11. Furniture hinge according to claim 9, wherein the protuberance on the slider is provided with a substantially pointed end, suitable to press on the profiles with saw tooth sections of the spiral grooves during closing of the door starting from a partially open position of the door itself.

12. Furniture hinge according to claim 4, wherein there are provided suitable circular grooves and ribs on the lower surface of the disc coupled respectively to complementary ribs and grooves provided on a base of the hinge.

13. Furniture hinge according to claim 7, wherein there are provided suitable circular grooves and ribs on the lower surface of the disc coupled respectively to complementary ribs and grooves provided on a base of the hinge.

14. Method for assembling a furniture hinge comprising a fixing arm for fixing to a piece of furniture, means for fixing to a door of said piece of furniture, incorporating a cup, first and second rockers, a slider, kinematic means for conversion of a translational motion of the slider into a damping pivoting motion, damping moving elements, a housing; said method comprising the steps:

assembling the hinge comprising the fixing arm, the cup and the first and second rockers, forming an articulated quadrilateral and joining said fixing arm to said cup so as to allow reciprocal pivoting thereof;

assembling in the housing the slider, the damping moving elements and the kinematic means for conversion of a translational motion of the slider into a damping pivoting motion of said damping moving elements;

fixing said housing to one end of said cup of the hinge in a single operation by means of fast connection means.

15. A furniture hinge comprising:

a fixing arm for fixing to a piece of furniture, a cup for fixing to a door of said piece of furniture, first and second rockers, forming an articulated quadrilateral and joining said fixing arm to said cup so as to allow reciprocal pivoting thereof, a connection element fixed to the first rocker, a housing comprising a casing and a base;

a damper disposed in said housing, said damper for damping a reciprocal pivoting movement, said damper comprising:

a slider, controlled in translation by the connection element and suitable to translate according to a first direction corresponding to a pivoting of the hinge, a kinematic element, said slider cooperating with said kinematic element for motion conversion suitable to convert a translational motion of the slider into a damping pivoting motion, a viscous medium disposed in said housing;

wherein said cup is separate from said housing, and wherein said housing encloses said slider, said housing comprises a said casing element being separate from said cup such that when said cup is moved away from said housing, said casing remains coupled to said base, said casing serving to guide the movement of said slider, damping moving elements, and said kinematic element for motion conversion, and wherein said housing comprises connection elements configured to connect to said cup, so that said slider and said damping moving elements are suitable to be assembled with one another with said housing so that said damper forms a single element suitable to be fixed to one end of said cup in a single operation.

16. The furniture hinge as in claim 15, wherein said cup has an aperture and said housing has an aperture, wherein said aperture of said cup is smaller than said aperture of said housing.

17. The furniture hinge as in claim 15, wherein said housing comprises a casing forming one side enclosure and a base disc, forming an opposite side enclosure.

18. A furniture hinge comprising:

a fixing arm for fixing to a piece of furniture, a cup for fixing to a door of said piece of furniture, first and second rockers, forming an articulated quadrilateral and joining said fixing arm to said cup so as to allow reciprocal pivoting thereof, a connection element fixed to the first rocker, a housing comprising a casing and a base said housing being external to said cup;

a damper disposed in said housing, said damper for damping a reciprocal pivoting movement, said damper comprising:

a slider, controlled in translation by the connection element and suitable to translate according to a first direction corresponding to a pivoting of the hinge, a kinematic element said slider cooperating with said kinematic element for motion conversion suitable to convert a translational motion of the slider into a damping pivoting motion, a viscous medium disposed in said housing;

wherein said cup is separate from said housing, and wherein said housing encloses said slider, said housing comprises first and second delimitation parts which are mutually engaged with each other with said first delimitation part overlapping the base plate of said cup, and wherein said sliding element is slidingly guided along the hole of the first delimitation part and takes movement through the hole of the base plate, wherein the housing has a peripheral side enclosure for lateral containment of the damper.

19. The furniture hinge as in claim 18, wherein said cup comprises at least one indentation configured to receive at least one protrusion of said casing.

* * * * *